US012636535B1

(12) United States Patent
Chen

(10) Patent No.: US 12,636,535 B1
(45) Date of Patent: May 26, 2026

(54) FITNESS BAR

(71) Applicant: Wei Chen, Zhejiang (CN)

(72) Inventor: Wei Chen, Zhejiang (CN)

( * ) Notice: Subject to any disclaimer, the term of this patent is extended or adjusted under 35 U.S.C. 154(b) by 0 days.

(21) Appl. No.: 19/441,716

(22) Filed: Jan. 6, 2026

(30) Foreign Application Priority Data

Jan. 10, 2025 (CN) ..... 202520066423.7
Mar. 10, 2025 (CN) ..... 202520413675.2
Mar. 20, 2025 (CN) ..... 202520502115.4

(51) Int. Cl.
*A63B 21/02* (2006.01)
*A63B 15/00* (2006.01)
*A63B 21/00* (2006.01)

(52) U.S. Cl.
CPC ..... *A63B 21/026* (2013.01); *A63B 15/00* (2013.01); *A63B 21/023* (2013.01); *A63B 21/00196* (2013.01)

(58) Field of Classification Search
CPC . A63B 21/023; A63B 21/026; A63B 21/0004; A63B 21/00043; A63B 21/00178; A63B 21/00196; A63B 21/4033; A63B 21/4035; A63B 15/00
See application file for complete search history.

(56) References Cited

U.S. PATENT DOCUMENTS 4,856,776 A * 8/1989 Ching-Liang ..... A63B 21/045 482/122
5,405,138 A * 4/1995 Duran ..... A63B 69/3635 473/457
5,599,021 A * 2/1997 Lary ..... A63B 15/00 482/92
8,777,821 B2 * 7/2014 Lando ..... A63B 23/1245 482/121
9,415,286 B2 * 8/2016 Lovelace ..... A63B 23/03516
9,795,838 B2 * 10/2017 Kikel ..... A63B 21/1618
10,039,950 B2 * 8/2018 Hao ..... A63B 22/20
10,220,237 B2 * 3/2019 Bentley ..... A63B 21/4035
10,449,406 B2 * 10/2019 Alnajjar ..... A63B 21/4035

FOREIGN PATENT DOCUMENTS

CN 223732034 U * 12/2025
KR 20180000761 U * 3/2018 ..... A63B 23/14

* cited by examiner

*Primary Examiner* — Megan Anderson
(74) *Attorney, Agent, or Firm* — Birchwood IP

(57) ABSTRACT

A fitness bar that is formed by a bar body and a handle. The bar body is a continuous helical spring including a vibrating portion, a transition portion, and a connecting portion. Both the vibrating portion and the connecting portion are shaped like a cylindrical helical spring, and the transition portion is shaped like a conical helical spring that tapers from the vibrating portion to the connecting portion. The handle is fixedly connected to the connecting portion. The connecting portion has a reduced diameter compared with the vibrating portion. When a user grips the handle and whips or swings the fitness bar, the vibrating portion is driven to vibrate elastically in a direction of whipping or swinging.

9 Claims, 8 Drawing Sheets

FITNESS BAR

TECHNICAL FIELD

The present disclosure relates to the field of fitness equipment, and in particular to a fitness bar.

BACKGROUND OF THE INVENTION

The Chinese patent CN222163177U discloses a connection structure for a fitness device, and the structure includes a detachably connected handle and an elastic rod. The elastic rod is provided with a spring portion connected to the handle, a mounting protrusion is arranged on the handle, a helical groove is formed around an outer periphery of the mounting protrusion, the spring portion is sleeved on the mounting protrusion and fitted with the helical groove, and the handle and the elastic rod are fixed relatively through cooperation of the spring portion and the helical groove. Reciprocating motion of the handle is controlled, and the spring portion causes vibration of the handle.

However, this structure has the following defects due to integrated uniform-diameter structure design of the elastic rod: First, the handle cannot be universally adapted to elastic rods of different diameters, thereby leading to inconvenience in replacement and maintenance, resource waste and the like; second, the handle, especially for a fitness bar with a larger-diameter elastic rod, is excessively thick, such that the user feels uncomfortable and powerless when gripping, thereby compromising motion accuracy and exercise efficiency; and third, excessively insufficient connection of the elastic rod with the handle results in a small contact area therebetween, which easily causes connection instability and loosening during use.

BRIEF SUMMARY OF THE INVENTION

In order to overcome the defects in the prior art, an objective of the present disclosure is to provide a fitness bar with a bar body of an integrated variable-diameter helical spring structure, which not only facilitates universalized handle design, but also ensures that the fitness bar is used in a comfortable, robust and non-slippage manner due to secure connection of the handle.

The objective of the present disclosure is achieved through the following technical solution:

A fitness bar, including a bar body and a handle, where the bar body is of a helical spring structure, including a vibrating portion, a transition portion, and a connecting portion that are integrally formed and sequentially connected; both the vibrating portion and the connecting portion are shaped like a cylindrical helical spring, and an outer diameter and a pitch of the connecting portion are smaller than an outer diameter and a pitch of the vibrating portion; the transition portion is shaped like a conical helical spring that tapers from the vibrating portion to the connecting portion; the handle is fixedly connected to the connecting portion in a detachable or non-detachable manner; and when a user grips the handle and whips or swings the fitness bar, the vibrating portion is driven to vibrate elastically in a direction of whipping or swinging.

Further, a pitch of the transition portion is identical to the pitch of the connecting portion, a length of the vibrating portion is more than twice a length of the connecting portion, and a length of the transition portion is less than the length of the connecting portion.

Further, the vibrating portion, the transition portion, and the connecting portion are integrally formed from a metal spring wire, pitches of the transition portion and the connecting portion are identical to a diameter of the metal spring wire, and the pitch of the vibrating portion is more than twice the diameter of the metal spring wire.

As an embodiment, the handle includes a front handle end, a handle body, and a rear handle end that are integrally formed and sequentially connected, the front handle end, the handle body, and the rear handle end are all located on a same axis, and an outer diameter of the handle body is smaller than outer diameters of the front handle end and the rear handle end.

Further, the handle is provided with a hollow cavity with an opening formed at the front handle end, and the hollow cavity includes a first chamber that is located at an opening end of the handle and configured to accommodate the transition portion, and a second chamber configured to accommodate the connecting portion, where a shape of the first chamber matches an outer contour of the transition portion, and the first chamber and the second chamber are communicated with each other and located on a same axis.

Preferably, a first helical groove that is fitted with an outer peripheral surface of the connecting portion is formed on an inner wall of the second chamber, to achieve a helical connection between the handle and the connecting portion.

Alternatively, the hollow cavity further includes a third chamber located inside the rear handle end, the third chamber and the second chamber are communicated with each other and located on a same axis, the third chamber is provided with a first connecting column that is integrally formed therewith and extends toward the second chamber, the first connecting column is sleeved within an inner diameter of the connecting portion, and a second helical groove that is fitted with an inner peripheral surface of the connecting portion is formed on an outer wall of the first connecting column, to achieve a helical connection between the handle and the connecting portion.

As another embodiment, the handle includes the front handle end, the handle body, and an end cap that are sequentially arranged and located on a same axis, the front handle end and the handle body are integrally formed, the end cap and the handle body are arranged separately, and an outer diameter of the handle body is smaller than outer diameters of the front handle end and the end cap.

Further, the front handle end is sleeved over the transition portion, and the handle body is sleeved over the connecting portion; the end cap is provided with a second connecting column that extends towards the front handle end, the second connecting column is sleeved within the inner diameter of the connecting portion, and a third helical groove that is fitted with an inner peripheral surface of the connecting portion is formed on an outer wall of the second connecting column, to achieve a helical connection between the end cap and the connecting portion; and an inner side of the end cap presses against the handle body to ensure that the handle is not detached from the connecting portion.

An end of the vibrating portion away from the transition portion is a free end, a soft rubber sleeve is sleeved on the free end, a pitch of the free end is identical to the diameter of the metal spring wire, and a hanging strap is connected to the handle.

Compared with the prior art, the present invention has the following beneficial effects:

Compared to the prior art, the integrated variable-diameter helical spring structure of the bar body of the fitness bar of the present disclosure is more reasonable and reliable.

Specifically, a structural design that the transition portion tapers from the vibrating portion to the connecting portion has the following benefits: in an aspect, to meet requirements for using fitness bars of different diameters, vibrating portions of different diameters are required, while connecting portions are of the same diameter, such that the handle matched with the connecting portion of the present disclosure is universally applied to fitness bars of different diameters, thereby conserving resources, reducing costs, and enhancing convenience of product maintenance; in a further aspect, a diameter reduction design of the connecting portion enables the handle to be more appropriately sized in diameter, which ensures that the user grips the fitness bar in a comfortable and robust manner, without negative impact on motion; and in still a further aspect, an increased axial length of connection between the bar body and the handle enlarges a contact area between the handle and the bar body, which enhances stability of connection between the handle and the bar body and prevents loosening during use.

DETAILED DESCRIPTION OF THE INVENTION

The present disclosure will be further described in detail below with reference to the embodiments shown in the accompanying drawings.

Figure 1:
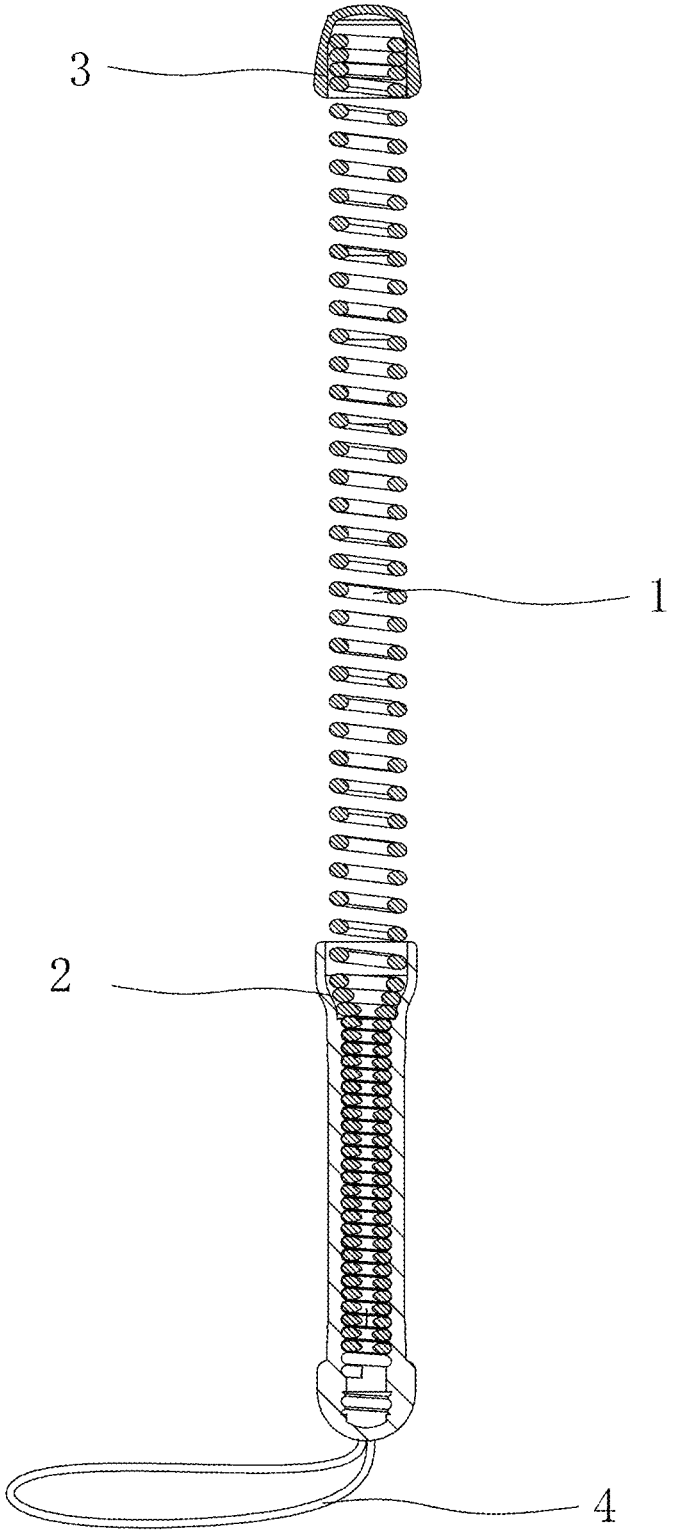
FIG. 1 is a schematic sectional view of a fitness bar of the present disclosure.
Figure 2:
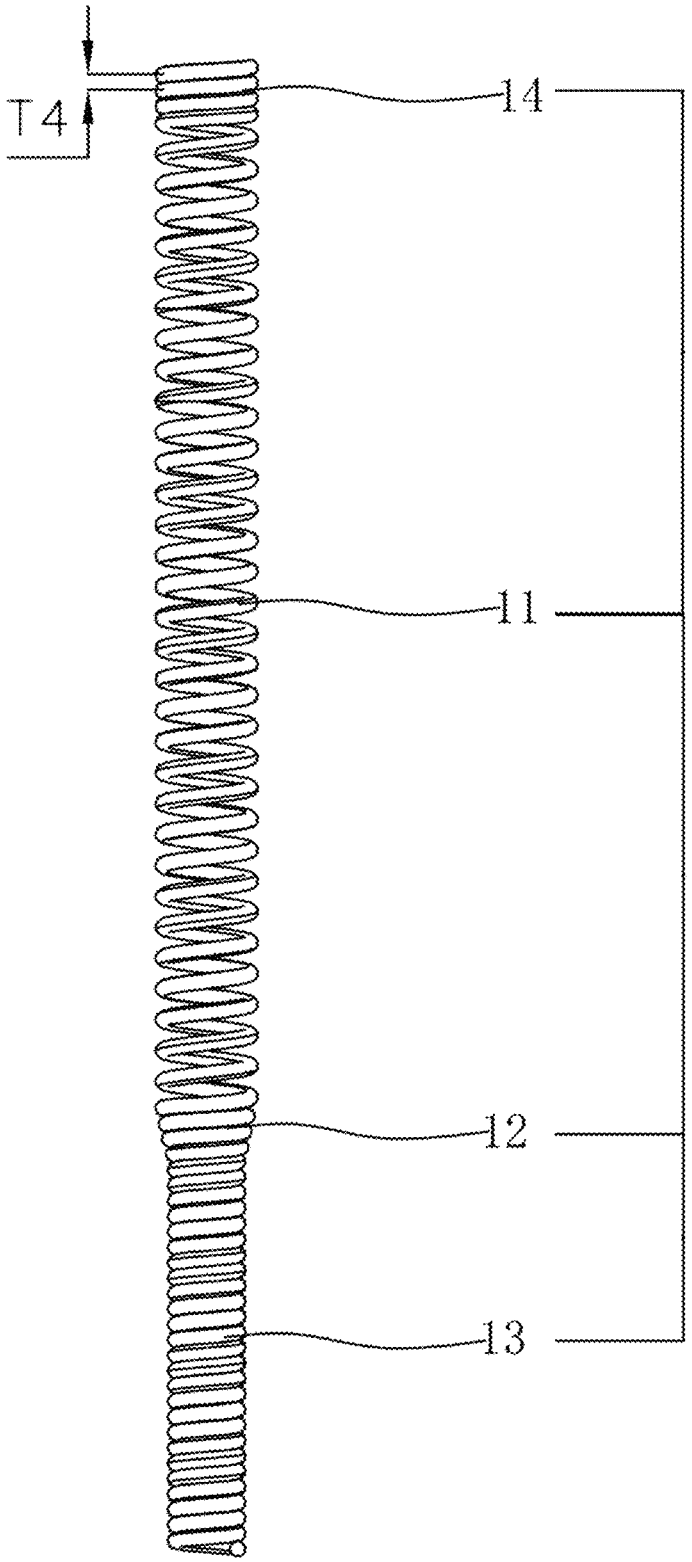
FIG. 2 is a schematic diagram of an outline of a bar body of the present disclosure.
Figure 3:
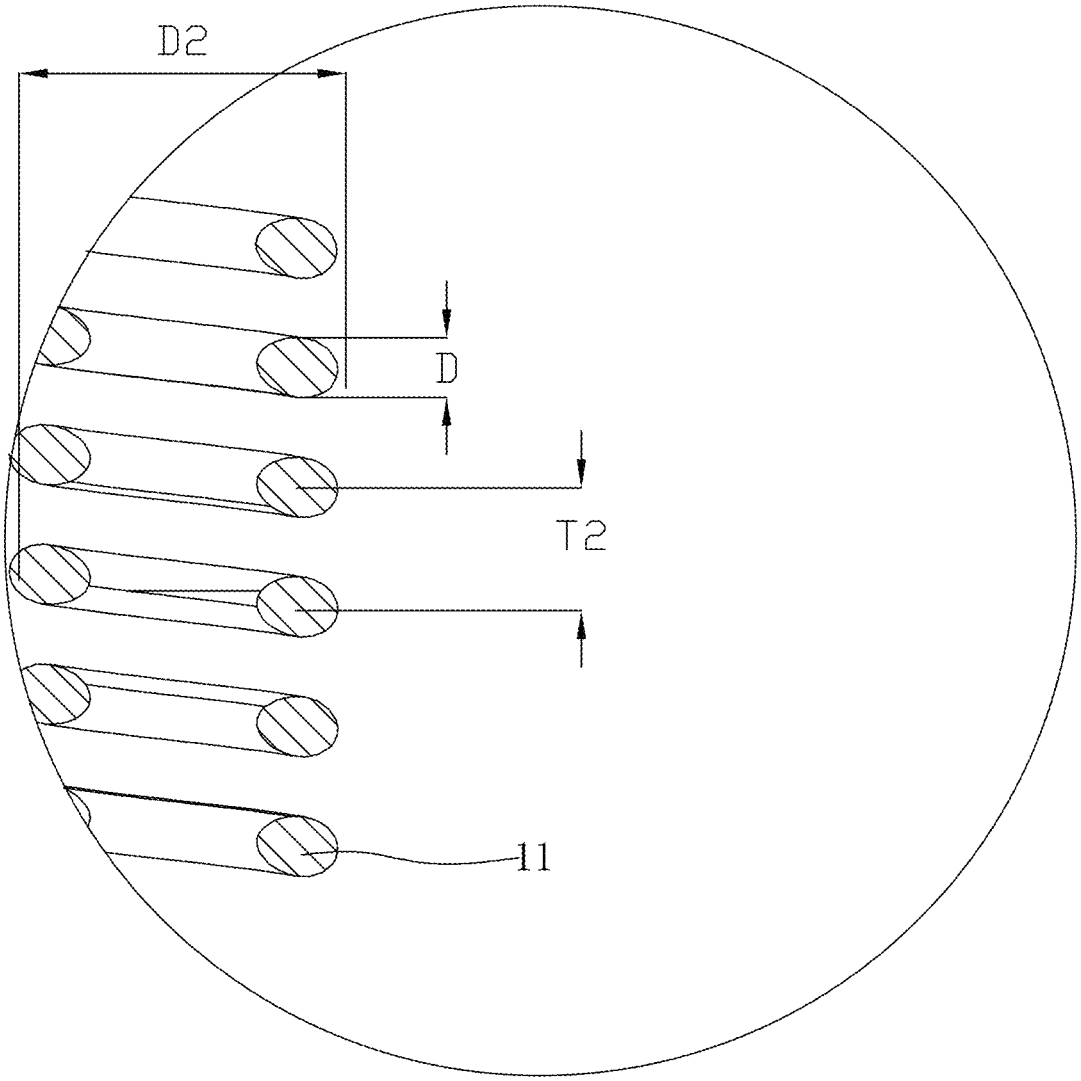
FIG. 3 is a partially enlarged schematic sectional view of a vibrating portion on a bar body of the present disclosure.
Figure 4:
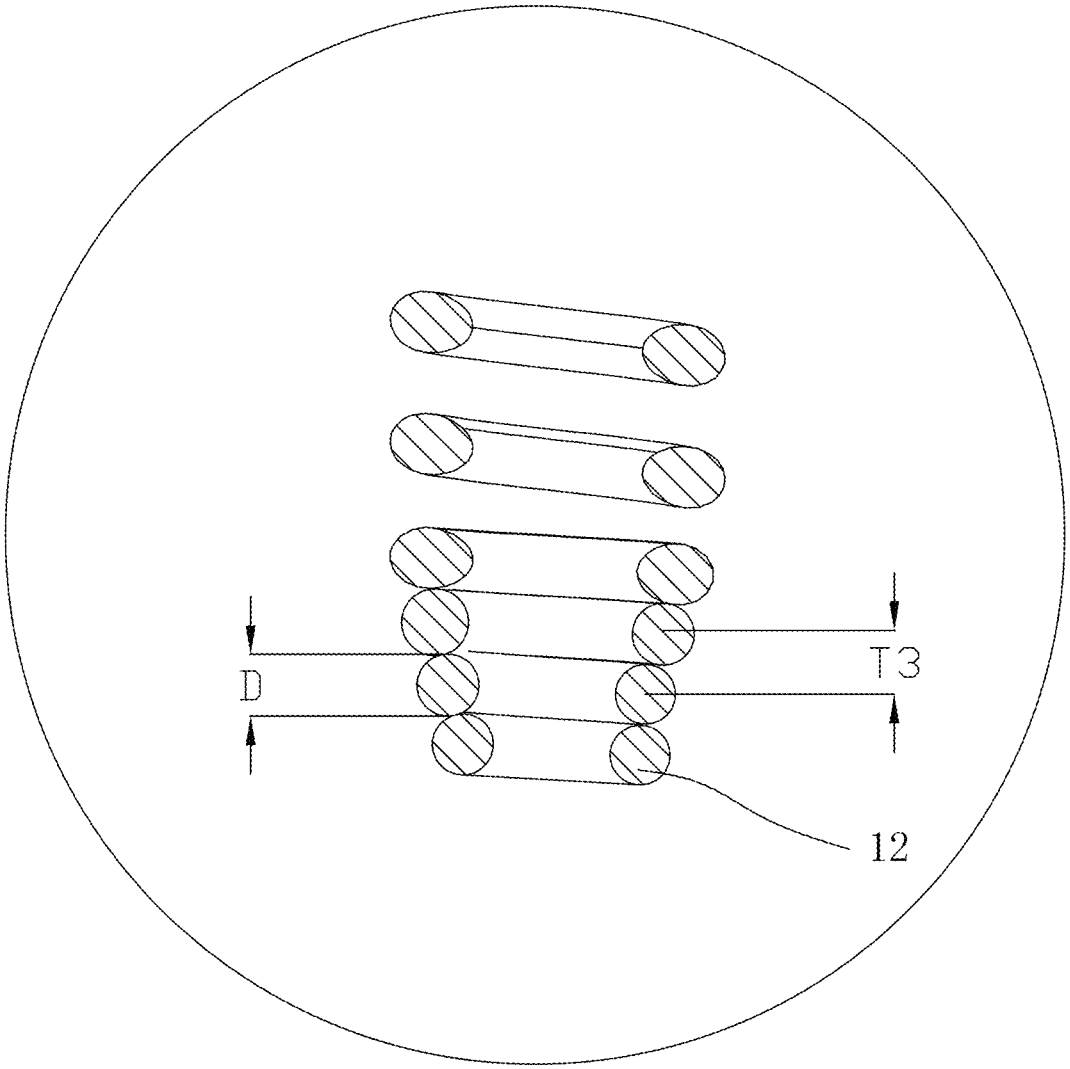
FIG. 4 is a partially enlarged schematic sectional view of a transition portion on a bar body of the present disclosure.
Figure 5:
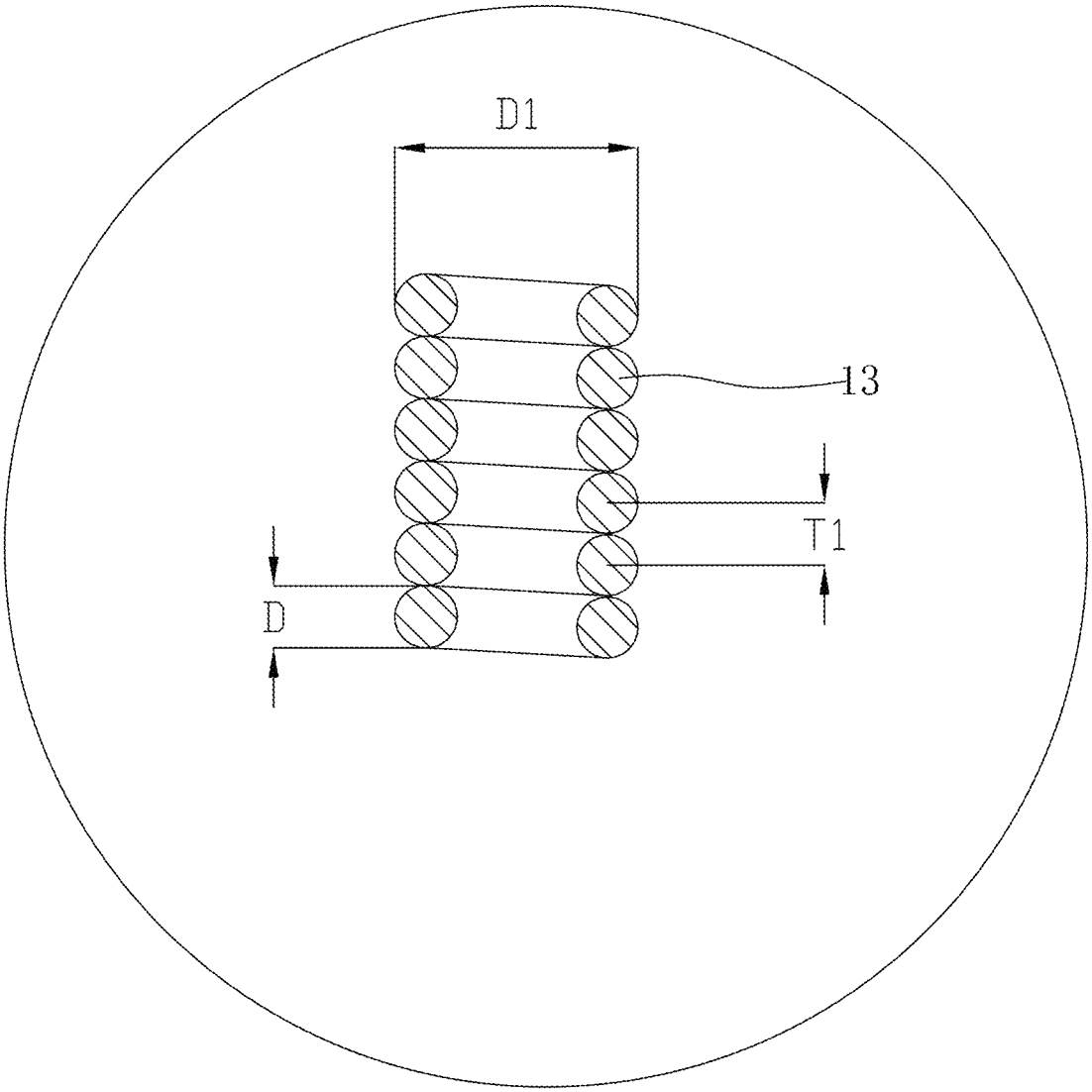
FIG. 5 is a partially enlarged schematic sectional view of a connecting portion on a bar body of the present disclosure.
Figure 6:
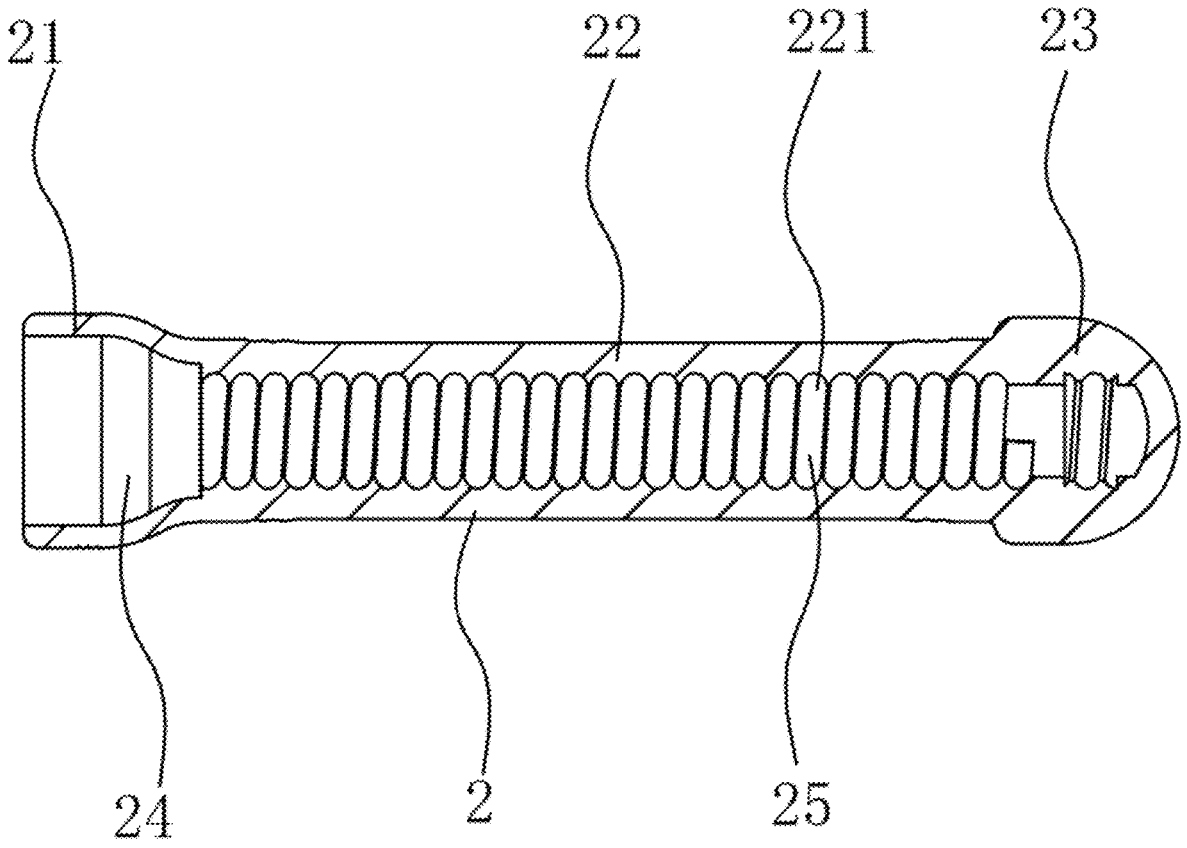
FIG. 6 is a schematic sectional view of a handle in Example 1 of the present disclosure.

As illustrated in FIGS. 1-6, a fitness bar according to Example 1 of the present disclosure includes a bar body 1 and a handle 2. The bar body 1 is of a helical spring structure, and the bar body 1 includes a vibrating portion 11, a transition portion 12, and a connecting portion 13 that are integrally formed and sequentially connected, where both the vibrating portion 11 and the connecting portion 13 are shaped like a cylindrical helical spring, an outer diameter D1 and a pitch T1 of the connecting portion 13 are smaller than an outer diameter D2 and a pitch T2 of the vibrating portion 11, and the transition portion 12 is shaped like a conical helical spring that tapers from the vibrating portion 11 to the connecting portion 13. The handle 2 is fixedly connected to the connecting portion 13 in a detachable or non-detachable manner. Detachable fixed connections include a helical connection, a snap-fit connection, and the like (not illustrated in the accompanying drawings), and non-detachable fixed connections include welding, integral injection molding, and the like (not illustrated in the accompanying drawings). When a user grips the handle 2 and whips or swings the fitness bar, the vibrating portion 11 is driven to vibrate elastically in a direction of whipping or swinging.

A pitch T3 of the transition portion 12 is identical to the pitch T1 of the connecting portion 13. A length of the vibrating portion 11 is more than twice a length of the connecting portion 13, and a length of the transition portion 12 is less than the length of the connecting portion 13.

The handle 2 is made of a plastic material, and the vibrating portion 11, the transition portion 12, and the connecting portion 13 are integrally formed from a metal spring wire. The pitch T1 of the connecting portion 13 and the pitch T3 of the transition portion 12 are both equal to a diameter D of the metal spring wire, that is, two adjacent spring coils in the connecting portion 13 and the transition portion 12 are arranged in an overlapping manner, which not only enhances a structural strength of the two portions, but also increases a contact area between the handle 2 and the bar body 1, such that the bar body 1 is not easily detached from the handle 2.

The pitch T2 of the vibrating portion 11 is more than twice the diameter D of the metal spring wire. Preferably, the pitch T2 of the vibrating portion 11 is 3-8 times the diameter D of the metal spring wire, such that bending flexibility and inertial performance of the vibrating portion 11 are optimized when the fitness bar is used.

The handle 2 includes a front handle end 21, a handle body 22, and a rear handle end 23 that are integrally formed and sequentially connected, where the front handle end 21, the handle body 22, and the rear handle end 23 are all located on a same axis, and an outer diameter of the handle body 22 is smaller than outer diameters of the front handle end 21 and the rear handle end 23, which prevents a hand of the user from slipping off the handle 2 when the fitness bar is used, thereby enhancing product safety.

The handle 2 is provided with a hollow cavity with an opening formed at the front handle end 21, and the hollow cavity includes a first chamber 24 that is located at an opening end of the handle 2 and configured to accommodate the transition portion 12, and a second chamber 25 configured to accommodate the connecting portion 13, where a shape of the first chamber 24 matches an outer contour of the transition portion 12, and the first chamber 24 and the second chamber 25 are communicated with each other and located on a same axis.

A first helical groove 221 that is fitted with an outer peripheral surface of the connecting portion 13 is formed on an inner wall of the second chamber 25, to achieve a helical connection between the handle 2 and the connecting portion 13.

An end of the vibrating portion 11 away from the transition portion 12 is a free end 14, and a soft rubber sleeve 2 is sleeved on the free end 14, where the soft rubber sleeve 2 protects the free end 14 from damage, thereby extending service life and enhancing aesthetics of the fitness bar. A pitch T4 of the free end 14 is identical to the diameter D of the metal spring wire, which increases an inertial momentum of the vibrating portion 11 when the fitness bar is used. Moreover, the free end 14 and the vibrating portion 11 are integrally formed, thereby preventing detachment from each other, and ensuring structural stability. A hanging strap 4 is connected to the handle 2, and the hanging strap 4 is looped around a wrist of the user during exercise, to prevent the handle 2 from slipping out of the hand, thereby improving operational safety.

As described above, a process of assembling and disassembling the fitness bar in Example 1 of the present disclosure is as follows: an end of the connecting portion 13 on the bar body 1 is aligned with and abuts against the second chamber 25 inside the handle 2, and the bar body 1 rotates relative to the handle 2 until the connecting portion 13 on the bar body 1 is screwed into the first helical groove 221 of the handle 2, to complete assembly of the bar body 1 and the handle 2. Therefore, the bar body 1 and the handle 2 are assembled in a very convenient manner. Similarly, the bar body 1 is detached from the handle 2 by rotating the bar body 1 relative to the handle 2 in an opposite direction.

Figure 7:
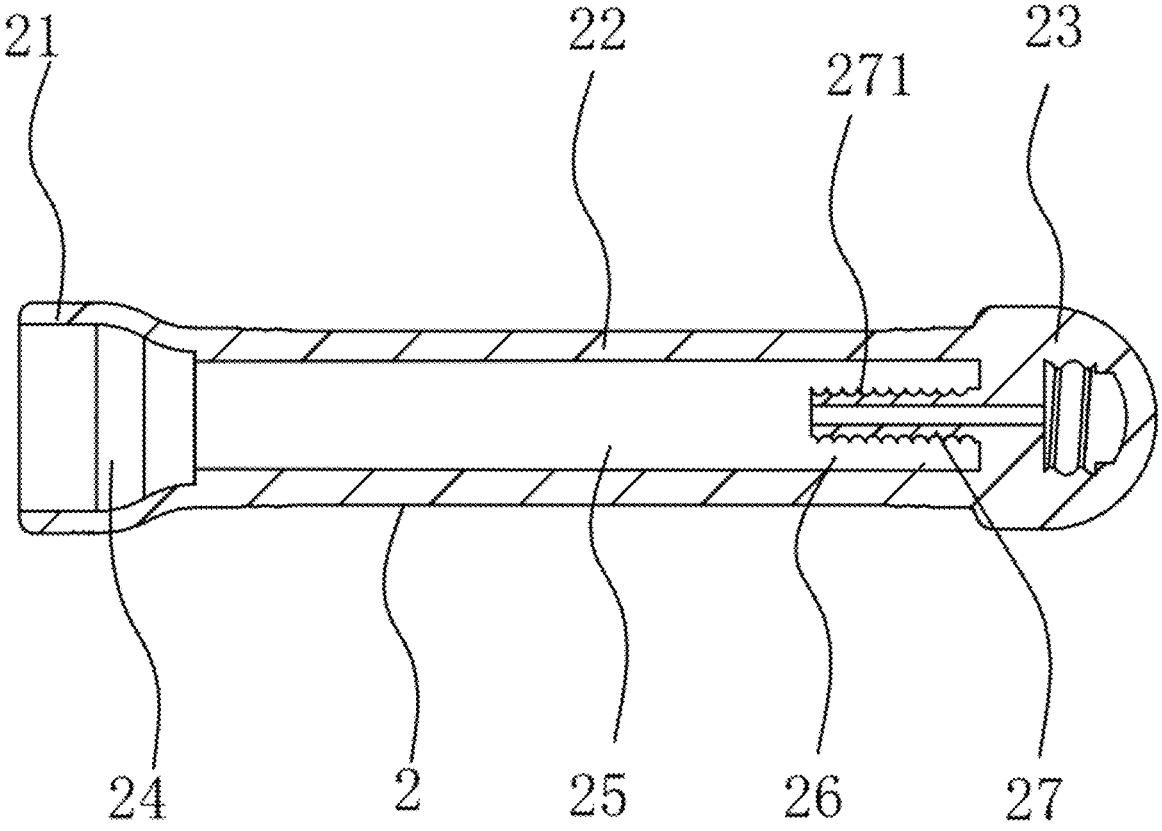
FIG. 7 is a schematic sectional view of a handle in Example 2 of the present disclosure.

As illustrated in FIGS. 1-7, Example 2 of the present disclosure differs from Example 1 in that: the hollow cavity further includes a third chamber 26 located inside the rear handle end 23, the third chamber 26 and the second chamber 25 are communicated with each other and located on a same axis, the third chamber 26 is provided with a first connecting column 27 that is integrally formed therewith and extends toward the second chamber 25, the first connecting column 27 is sleeved within an inner diameter of the connecting portion 13, and a second helical groove 271 that is fitted with an inner peripheral surface of the connecting portion 13 is formed on an outer wall of the first connecting column 27, to achieve a helical connection between the handle 2 and the connecting portion 13.

As described above, a process of assembling and disassembling the fitness bar in Example 2 of the present disclosure is as follows: an end of the connecting portion 13 on the bar body 1 is inserted into the handle body 22 and abuts against an end face of the first connecting column 27 inside the handle 2, and the bar body 1 rotates relative to the handle 2 until the connecting portion 13 is screwed into the second helical groove 271 of the first connecting column 27, to complete assembly of the bar body 1 and the handle 2. Similarly, disassembly is completed by rotating the bar body 1 relative to the handle 2 in an opposite direction.

Figure 8:
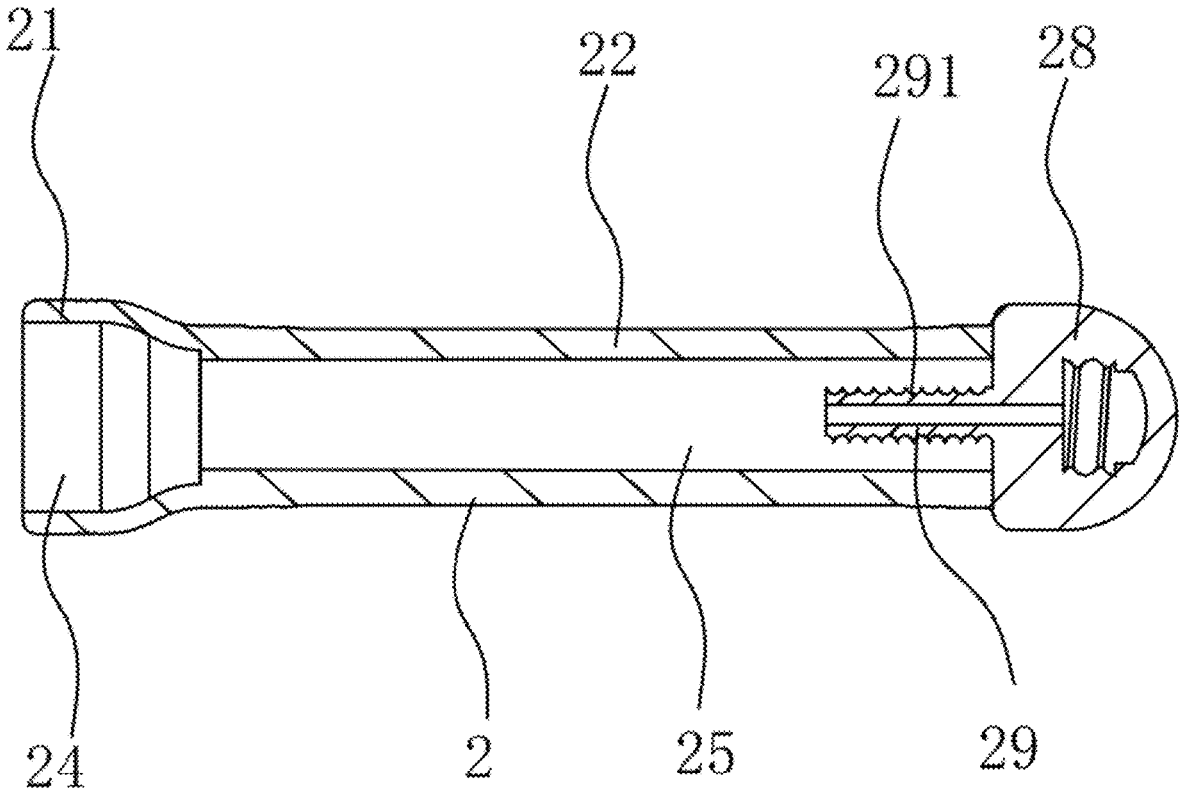
FIG. 8 is a schematic sectional view of a handle in Example 3 of the present disclosure.

As illustrated in FIGS. 1-6 and 8, Example 3 of the present disclosure differs from Example 1 in that: the handle 2 includes the front handle end 21, the handle body 22, and an end cap 28 that are sequentially arranged and located on a same axis, the front handle end 21 and the handle body 22 are integrally formed, the end cap 28 and the handle body 22 are arranged separately, an outer diameter of the handle body 22 is smaller than outer diameters of the front handle end 21 and the end cap 28, the front handle end 21 is sleeved over the transition portion 12, and the handle body 22 is sleeved over the connecting portion 13; the end cap 28 is provided with a second connecting column 29 that extends towards the front handle end 21, the second connecting column 29 is sleeved within the inner diameter of the connecting portion 13, and a third helical groove 291 that is fitted with an inner peripheral surface of the connecting portion 13 is formed on an outer wall of the second connecting column 29, to achieve a helical connection between the end cap 28 and the connecting portion 13; and an inner side of the end cap 28 presses against the handle body 22 to ensure that the handle 2 is not detached from the connecting portion 13.

As described above, a process of assembling and disassembling the fitness bar in Example 3 of the present disclosure is as follows: an end of the connecting portion 13 on the bar body 1 is inserted into the handle body 22, the second connecting column 29 on the end cap 28 abuts against an end face of the connecting portion 13, and the bar body 1 rotates relative to the end cap 28 until the connecting portion 13 is screwed into the third helical groove 291 of the end cap 28, rotates to an inner side of the end cap 28 and presses against the handle body 22, to complete assembly of the bar body 1 and the handle 2. Similarly, the bar body 1 is detached from the handle 2 by rotating the bar body 1 relative to the end cap 28 in an opposite direction.

In the present disclosure, a length of the bar body 1 is 330-450 mm, and a length of the vibrating portion 11 is 300-400 mm.

The above described embodiments are merely preferred embodiments of the present disclosure, and the scope of implementations of the present disclosure shall not be defined thereby, that is, all simple equivalent changes and modifications made with respect to the patent scope and the description of the present disclosure shall fall within the scope of the present disclosure.

What is claimed is:

1. A fitness bar, comprising a bar body and a handle, wherein the bar body is of a helical spring structure, comprising a vibrating portion, a transition portion, and a connecting portion that are integrally formed and sequentially connected; both the vibrating portion and the connecting portion are shaped like a cylindrical helical spring, and an outer diameter and a pitch of the connecting portion are smaller than an outer diameter and a pitch of the vibrating portion; the transition portion is shaped like a conical helical spring that tapers from the vibrating portion to the connecting portion; the handle is fixedly connected to the connecting portion in a detachable or non-detachable manner; and when a user grips the handle and whips or swings the fitness bar, the vibrating portion is driven to vibrate elastically in a direction of whipping or swinging;

the handle is provided with a hollow cavity with an opening formed at a front handle end of the handle, and the hollow cavity comprises a first chamber that is located at an opening end of the handle and configured to accommodate the transition portion, and a second chamber configured to accommodate the connecting portion, wherein a shape of the first chamber matches an outer contour of the transition portion, and the first chamber and the second chamber are communicated with each other and located on a same axis.

2. The fitness bar according to claim 1, wherein a pitch of the transition portion is identical to the pitch of the connecting portion, a length of the vibrating portion is more than twice a length of the connecting portion, and a length of the transition portion is less than the length of the connecting portion.

3. The fitness bar according to claim 2, wherein the vibrating portion, the transition portion, and the connecting portion are integrally formed from a metal spring wire, the pitch of the transition portion and the connecting portion are identical to a diameter of the metal spring wire, and the pitch of the vibrating portion is more than twice the diameter of the metal spring wire.

4. The fitness bar according to claim 3, wherein the handle comprises the front handle end, the handle body, and an end cap that are sequentially arranged and located on a same axis, the front handle end and the handle body are integrally formed, the end cap and the handle body are arranged separately, and an outer diameter of the handle body is smaller than outer diameters of the front handle end and the end cap.

5. The fitness bar according to claim 4, wherein the front handle end is sleeved over the transition portion, and the handle body is sleeved over the connecting portion; the end cap is provided with a second connecting column that extends towards the front handle end, the second connecting column is sleeved within the inner diameter of the connecting portion, and a third helical groove that is fitted with an inner peripheral surface of the connecting portion is formed on an outer wall of the second connecting column, to achieve a helical connection between the end cap and the connecting portion; and an inner side of the end cap presses against the handle body to ensure that the handle is not detached from the connecting portion.

6. The fitness bar according to claim 3, wherein the handle also comprises a handle body and a rear handle end; the front handle end, the handle body, and the rear handle end are integrally formed and sequentially connected, the front handle end, the handle body, and the rear handle end are all located on a same axis, and an outer diameter of the handle body is smaller than outer diameters of the front handle end and the rear handle end.

7. The fitness bar according to claim 3, wherein an end of the vibrating portion away from the transition portion is a free end, a soft rubber sleeve is sleeved on the free end, a pitch of the free end is identical to the diameter of the metal spring wire, and a hanging strap is connected to the handle.

8. The fitness bar according to claim 1, wherein a first helical groove that is fitted with an outer peripheral surface of the connecting portion is formed on an inner wall of the second chamber, to achieve a helical connection between the handle and the connecting portion.

9. The fitness bar according to claim 1, wherein the hollow cavity further comprises a third chamber located inside the rear handle end, the third chamber and the second chamber are communicated with each other and located on a same axis, the third chamber is provided with a first connecting column that is integrally formed therewith and extends toward the second chamber, the first connecting column is sleeved within an inner diameter of the connecting portion, and a second helical groove that is fitted with an inner peripheral surface of the connecting portion is formed on an outer wall of the first connecting column, to achieve a helical connection between the handle and the connecting portion.

* * * * *